US009055782B2

(12) United States Patent
McDonnell

(10) Patent No.: US 9,055,782 B2
(45) Date of Patent: Jun. 16, 2015

(54) MULTISTRUCTURAL SUPPORT SYSTEM FOR A SOLE IN A RUNNING SHOE

(76) Inventor: Kevin McDonnell, La Jolla, CA (US)

( * ) Notice: Subject to any disclaimer, the term of this patent is extended or adjusted under 35 U.S.C. 154(b) by 1459 days.

(21) Appl. No.: 12/258,069

(22) Filed: Oct. 24, 2008

(65) Prior Publication Data

US 2010/0101111 A1 Apr. 29, 2010

(51) Int. Cl.

| | |
|---|---|
| ***A43B 13/18*** | (2006.01) |
| ***A43B 13/20*** | (2006.01) |
| ***A43B 17/02*** | (2006.01) |
| ***A43B 17/03*** | (2006.01) |
| ***A43B 1/00*** | (2006.01) |
| ***A43B 13/12*** | (2006.01) |

(52) U.S. Cl.

CPC ..... *A43B 13/181* (2013.01); *A43B 13/20* (2013.01); *A43B 17/03* (2013.01); *A43B 17/026* (2013.01); *A43B 1/0054* (2013.01); *A43B 13/12* (2013.01); *A43B 13/189* (2013.01); *A43B 13/206* (2013.01)

(58) Field of Classification Search

CPC .... A43B 13/181; A43B 13/189; A43B 13/20; A43B 13/206; A43B 17/026; A43B 17/03

USPC ..... 36/103, 2.6, 3 R, 3 B, 29, 35 B, 147, 153

See application file for complete search history.

(56) References Cited

U.S. PATENT DOCUMENTS

| | | | | | |
|---|---|---|---|---|---|
| 3,871,117 | A | * | 3/1975 | Richmond et al. | 36/43 |
| 4,509,510 | A | * | 4/1985 | Hook | 601/28 |
| 4,722,131 | A | | 2/1988 | Huang | |
| 4,763,426 | A | * | 8/1988 | Polus et al. | 36/29 |
| 4,813,160 | A | | 3/1989 | Kuznetz | |
| 4,817,304 | A | | 4/1989 | Parker et al. | |
| 4,905,383 | A | * | 3/1990 | Beckett et al. | 36/28 |
| 4,934,072 | A | | 6/1990 | Fredericksen et al. | |
| 4,936,030 | A | * | 6/1990 | Rennex | 36/28 |
| 5,097,607 | A | | 3/1992 | Fredericksen | |
| 5,155,927 | A | | 10/1992 | Bates et al. | |
| 5,179,792 | A | * | 1/1993 | Brantingham | 36/29 |
| 5,199,191 | A | * | 4/1993 | Moumdjian | 36/28 |
| 5,222,312 | A | * | 6/1993 | Doyle | 36/28 |
| 5,228,156 | A | | 7/1993 | Wang | |
| 5,363,570 | A | | 11/1994 | Allen et al. | |
| 5,400,526 | A | | 3/1995 | Sessa | |
| 5,543,194 | A | | 8/1996 | Rudy | |
| 5,802,739 | A | | 9/1998 | Potter et al. | |
| 5,806,208 | A | | 9/1998 | French | |

(Continued)

*Primary Examiner* — Khoa Huynh
*Assistant Examiner* — Sharon M Prange
(74) *Attorney, Agent, or Firm* — Felix L. Fischer

(57) ABSTRACT

A shoe structure for foot strike energy dissipation employs compressible members each having an internal void containing a first working fluid. A set of mating compressible members are each connected to a related one of the first compressible members through a fluid conduit such that the first working fluid is transferred from the related compressible member to the mating compressible member responsive to compression induced by foot strike. Resilient structural members are placed intermediate the compressible members to deform responsive to compression of the foot bed induced by foot strike provide both energy dissipation and resilient recovery of the compression cylinders to their uncompressed state. A cavity contains a second working fluid that is transmissible between the compressible members responsive to compression of the foot bed. Cooling tubes are provided for energy dissipation of the second working fluid which bathes the compressible members, conduits and resilient elements.

4 Claims, 13 Drawing Sheets

(56) References Cited

U.S. PATENT DOCUMENTS

| | | | | |
|---|---|---|---|---|
| 5,842,291 | A * | 12/1998 | Schmidt et al. | 36/29 |
| 5,853,844 | A | 12/1998 | Wen | |
| 5,916,664 | A | 6/1999 | Rudy | |
| 5,950,332 | A | 9/1999 | Lain | |
| 6,170,173 | B1 | 1/2001 | Caston | |
| 6,266,898 | B1 | 7/2001 | Cheng | |
| 6,354,020 | B1 | 3/2002 | Kimball et al. | |
| 6,430,843 | B1 | 8/2002 | Potter et al. | |
| 6,453,577 | B1 * | 9/2002 | Litchfield et al. | 36/29 |
| 6,457,262 | B1 | 10/2002 | Swigart | |
| 6,457,263 | B1 | 10/2002 | Rudy | |
| 6,519,797 | B1 | 2/2003 | Brubaker et al. | |
| 6,722,059 | B2 * | 4/2004 | Robinson et al. | 36/29 |
| 6,745,499 | B2 | 6/2004 | Christensen et al. | |
| 6,971,193 | B1 | 12/2005 | Potter et al. | |
| 7,073,278 | B2 * | 7/2006 | Cheng | 36/43 |
| 7,181,867 | B2 | 2/2007 | Litchfield et al. | |
| 7,200,956 | B1 | 4/2007 | Kotha et al. | |
| 7,219,449 | B1 | 5/2007 | Hoffberg et al. | |
| 7,712,229 | B2 * | 5/2010 | Yang | 36/3 B |
| 7,841,108 | B2 * | 11/2010 | Johnson et al. | 36/136 |
| 2003/0101619 | A1 | 6/2003 | Litchfield et al. | |
| 2006/0137221 | A1 | 6/2006 | Dojan et al. | |
| 2007/0033832 | A1 | 2/2007 | Marvin et al. | |
| 2007/0074423 | A1 | 4/2007 | Goodwin et al. | |
| 2007/0277395 | A1 | 12/2007 | Aveni et al. | |
| 2007/0294916 | A1 * | 12/2007 | Park | 36/29 |
| 2009/0056171 | A1 * | 3/2009 | Lin | 36/3 B |

* cited by examiner

MULTISTRUCTURAL SUPPORT SYSTEM FOR A SOLE IN A RUNNING SHOE

BACKGROUND OF THE INVENTION

1. Field of the Invention

This invention relates generally to the field of shoes including athletic or running shoes and, more particularly, to a structural support system having multiple fluid transfer and resilient structural elements to provide energy dissipation from foot strike and cooling for the user's foot.

2. Description of the Related Art

Athletes engaging in sports of various types continue to expand the limits of their performance. Impact from running or other rapid movement associated with these sports is increasingly creating various stress related injuries. Many activities are pursued by individuals in which heel strike or other foot impact including walking, hiking, running or other sports activities may contribute to repetitive stress injury or other long term complications. To allow increased endurance while reducing potential for injury sports shoes have been created which employs various structural techniques for absorbing energy to reduce impact created by foot strike. Resilient mechanical elements pneumatic bladders and other elements have been employed.

It is desirable to provide a shoe structure which adequately absorbs and dissipates impact energy that can be tailored to the activity such as walking, running, hiking or other sports in which the individual or athlete is engaged. It is further desirable to provide as an integral portion of the shoe structure cooling capability both for the energy dissipating structure and for the shoe in general for increased comfort.

SUMMARY OF THE INVENTION

The embodiments of the present invention described herein provide a shoe structure for foot strike energy dissipation employing a first plurality of compressible members each having an internal void containing a first working fluid. A second equal plurality of mating compressible members are each connected to a related one of the first plurality of compressible members through a fluid conduit such that the first working fluid is transferred from the related compressible member to the mating compressible member responsive to compression induced by foot strike. A flow restriction element may be associated with each fluid conduit. A sole pad and a foot bed intermediately constraining the first plurality of compressible members and the second equal plurality of mating compressible members for integration into the shoe.

In alternative embodiments, a plurality of resilient structural members are placed intermediate the compressible members. The resilient structural members deform responsive to compression of the foot bed induced by foot strike provide both energy dissipation and resilient recovery of the compression cylinders to their uncompressed state. The resilient structural members may be arcuate filaments extending from the sole pad with the arcuate members orthogonally surrounding each compressible member singly or in combination with upstanding filaments extending intermediate the sole pad and foot bed to provide a skeletal structure supporting and resiliently separating the sole pad and foot bed.

The embodiments of the structure for the athletic shoe additionally provide a plurality of cooling elements. The sole pad and foot bed are interconnected by a peripheral wall forming a cavity and which contains a second working fluid that is transmissible intermediate said the compressible members responsive to compression of the foot bed responsive to foot strike. The cooling tubes transversely extend intermediate said sole pad and foot bed and operatively exposed in said peripheral wall. The second working fluid additionally bathes the compressible members, conduits and flow restriction elements for heat transfer and energy dissipation.

Recovery of the compression cylinders and flow of the primary and secondary working fluids is assisted by the resilient reaction of the filament skeletal structure in expanding the foot bed and sole pad after compression due to foot strike.

In an enhanced embodiment, a buoyant magnet carried within the void of at least one compressible member. The buoyant magnet is displaced within the compressible member responsive to foot strike. An induction coil encircling the compressible member is operatively connected to a resistive element for energy dissipation responsive to electromagnetically generated current resulting from relative motion of the buoyant magnet. A repelling magnet having opposite polarity to the buoyant magnet is mounted proximate the bottom of the compressible member to prevent bottoming out of the buoyant magnet during compression.

BRIEF DESCRIPTION OF THE DRAWINGS

These and other features and advantages of the present invention will be better understood by reference to the following detailed description when considered in connection with the accompanying drawings wherein.

DETAILED DESCRIPTION OF THE INVENTION

Figure 1:
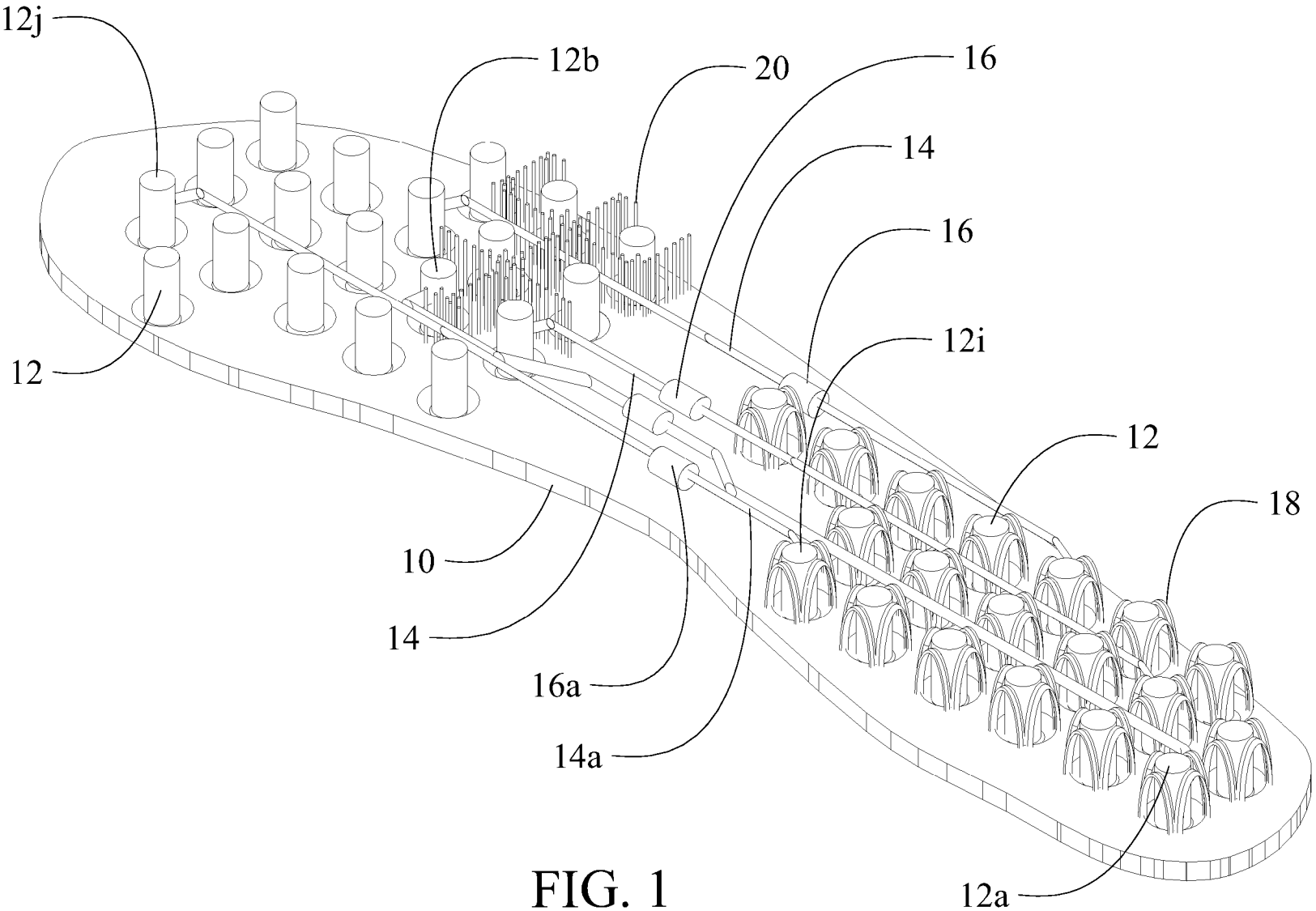
FIG. 1 is an isometric view partial section view showing the structural component's of a first embodiment of the invention.

Referring to the drawings FIG. 1 shows a sole pad 10 which in various embodiments is an insert received over the sole of an athletic shoe. In alternative embodiments the sole pad is integral with the sole and may incorporate various tread designs or other features on the bottom of the pad. Compression cylinders 12 constructed from resilient material such as natural or synthetic rubber and having a central void, as will be described in greater detail subsequently, extend from the sole pad upward. In an exemplary embodiment as shown in the drawings, the void in each compression cylinder is partially filled with a first working fluid leaving a compressible gas pad. In alternative embodiments, no gas working space remains in the cylinder and the walls of each cylinder are substantially collapsible when not engorged with fluid. Initial embodiments employ viscous oil as the first working fluid.

Each compression cylinder, for example cylinder 12*a*, is matched with a second compression cylinder, for example cylinder 12*b*, and interconnected with a fluid conduit 14. The number and placement of the compression cylinders is determined based on the shoe shape and desired impact absorption. For the embodiment shown multiple cylinders are placed in the heel section with matched cylinders placed in the toe section. A foot bed 11 overlies the compression cylinders encasing the support structure in combination with the sole pad.

Using cylinders 12*a* and 12*b* as examples, when the wearer takes a step creating an initial heel strike transmitted through the foot bed, cylinder 12*a* is compressed forcing the working fluid into conduit 14*a*. A flow restrictor 16*a* regulates flow of the fluid from the compressing cylinder 12*a* to cylinder 12*b* as the receiving cylinder. The gas pad in the receiving cylinder is compressed, or in alternative embodiments the collapsed cylinder walls expanded, and the combination of the compression of the resilient compression cylinder 12*a*, fluid transfer through the restriction, and gas pad compression or cylinder wall expansion in the receiving cylinder 12*b* provides multiple energy dissipation mechanisms to attenuate the heel strike thereby decreasing the energy transferred back to the foot from the ground. As the wearer's foot rolls forward the process is reversed resulting in compression of cylinder 12*b* with resulting fluid flow through the conduit and restriction back to cylinder 12*a*. Energy stored in the receiving cylinder by compression of the gas pad provides a rebound effect which is recovered during the roll through of the foot thereby contributing to a reduction in effort by the athlete.

Figure 2:
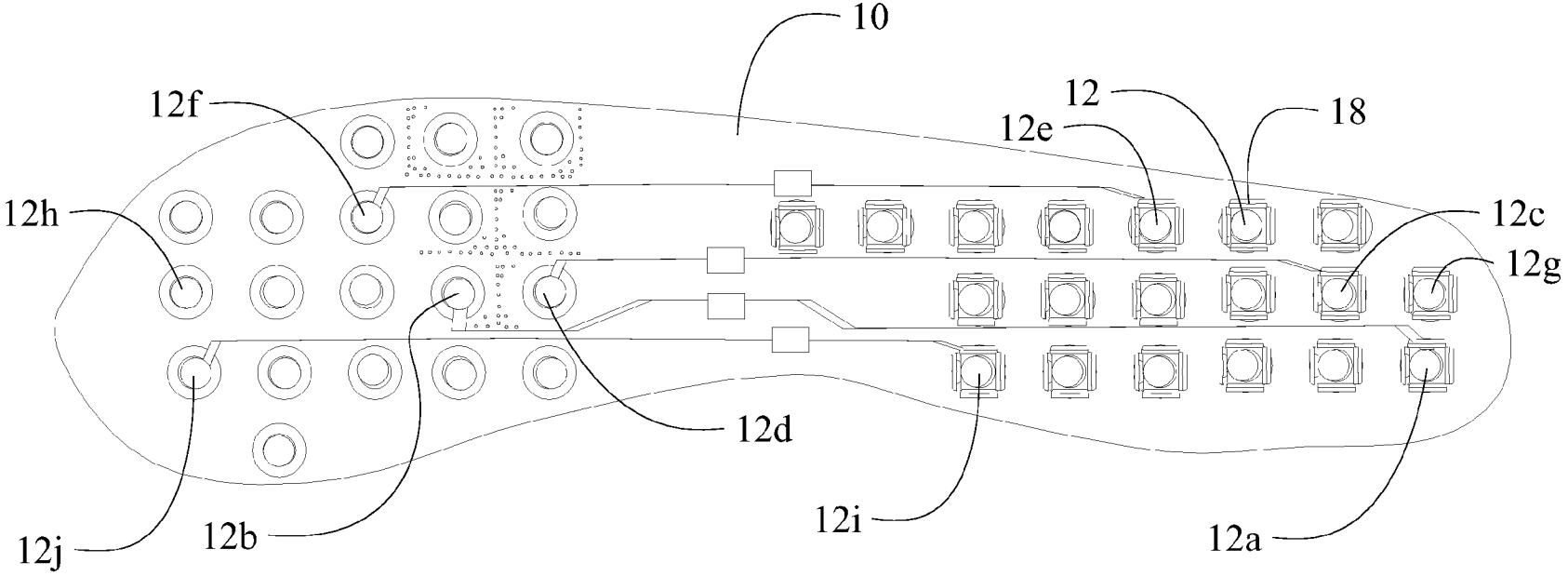
FIG. 2 is a top view of the embodiment shown in FIG. 1 with the foot bed removed for clarity.

FIG. 2 shows exemplary cylinder matching pairs with associated fluid conduits. For the described embodiment of cylinders 12*a*, 12*c* 12*e* and 12*g*, are arranged in a first row immediately adjacent the heel boundary of the sole pad. Matched cylinders 12*b*, 12*d*, 12*f*, and 12*h*, are located at the ball of the foot. Cylinder 12*i* is located at the forward extremity of the heel portion of the sole pad with mating cylinder 12*j* located at the forward periphery of the toe portion of the sole pad. In a working embodiment every compression cylinder 12 is matched with a second cylinder through an associated fluid conduit 14 with flow restrictor 16. For the embodiment shown flow restrictor 16 is a separate element. In alternative embodiments flow restriction is accomplished by sizing of the cross-sectional area in the conduit over its length or integral forming of an orifice or nozzle in the conduit.

Selected placement of the cylinders allows detailed control of energy transfer within the shoe structure to accommodate various pronation issues and to maximize the desired energy dissipation through maximizing the length of the fluid conduits based on the foot strike profile. For example a sprinting shoe would incorporate the matched cylinders within the toe portion of the shoe since heel strike does not typically occur. Matching of cylinders located under the ball of the foot with cylinders located under the toes would accommodate strike of the ball with roll through the toes for completion of the stride. In a distance running shoe, cross training shoe, or hiking shoe, as examples, heel strike is far more likely and matching of cylinders in the heel and toe portion provides the greatest energy dissipation. With a basketball shoe or court shoe, cylinders on the interior and exterior of the sole may be matched to accommodate torsional effects from rapid sideways motion or pivoting on the foot. Extending the compression effect over a region of the individual cylinders may be accomplished by including rigid portions or plates in the foot bed in the heel and toe regions.

Figure 3:
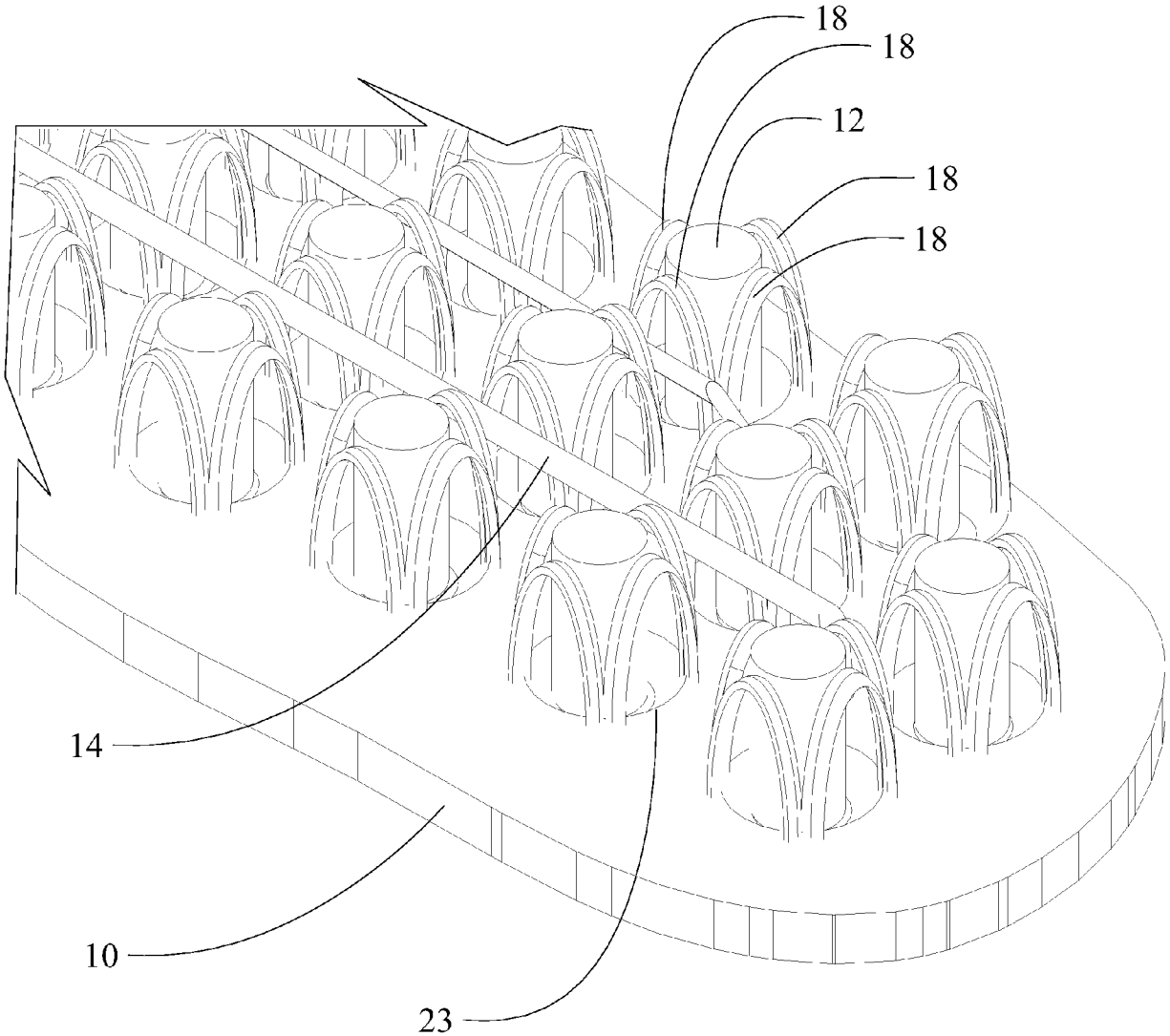
FIG. 3 is a detailed partial view showing structural elements of the first embodiment of the invention including compression cylinders and arcuate resilient members.
Figure 4:
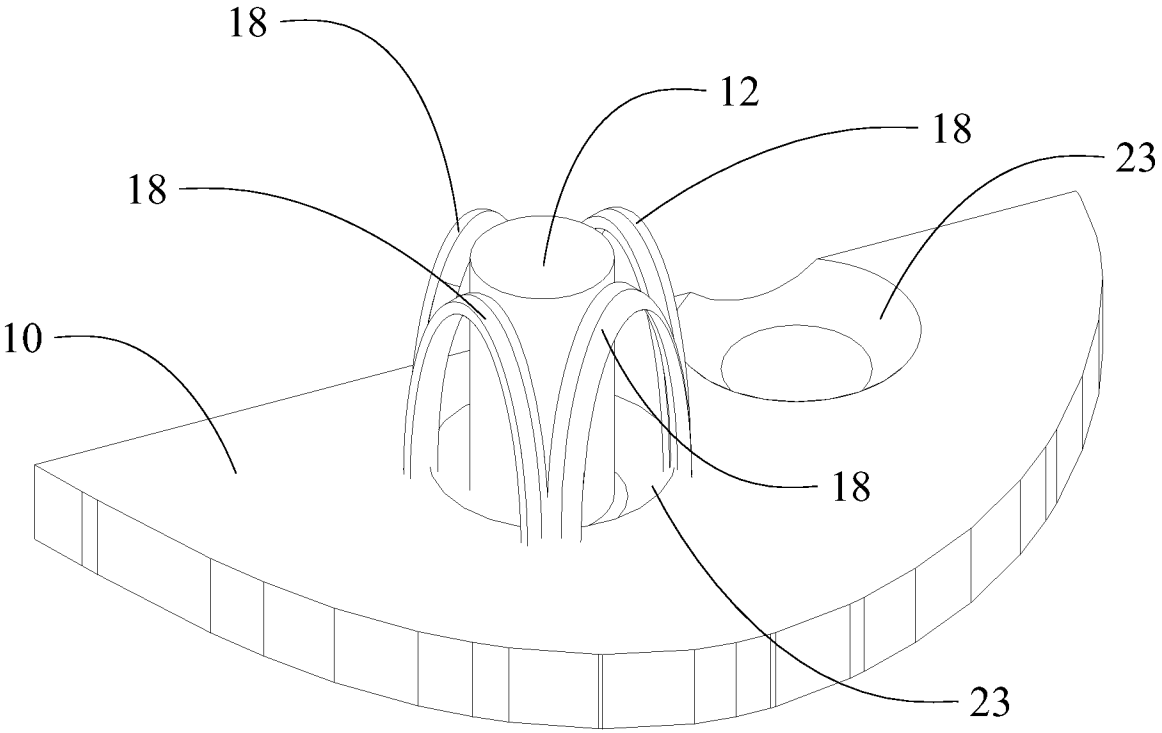
FIG. 4 is a detailed view of a single compression cylinder and associated arcuate resilient members.

FIG. 2 additionally shows supplemental structural elements employed in the embodiment disclosed in the drawings. Additional restoring force in the resilient cylinders is provided by arcuate resilient members 18. For the embodiments shown, it is anticipated that heel strike will be the desired source for major energy dissipation and the arcuate resilient members surround cylinders in the heel area. Greater detail with respect to placement and appearance of the arcuate members is shown in FIGS. 3 and 4. For the embodiment shown each cylinder is surrounded by four orthogonally placed arcuate resilient members. The embodiment shown in FIG. 2 and FIG. 3 employs spacing of the compression cylinders with a separate set of four arcuate resilient members for each cylinder. In embodiments with regular spacing of the compression cylinders single intermediate arcuate members may be employed between adjacent compression cylinders. The arcuate members may be formed as a portion of the sole pad molding process with the cylinders and associated fluid conduits inserted intermediate the arcuate members. As additionally shown for the embodiment in the drawings, the sole pad and foot bed may employ molded depressions 23 to individually seat the cylinders.

During foot strike compression of the cylinders is accompanied by resilient deformation of the arcuate members. Upon removal of the compression force relaxation of the compressed arcuate members enhances recovery of the compressed cylinder. For the embodiment shown the arcuate members provide restoring force against a foot bed as will be described in greater detail subsequently. In alternative embodiments the arcuate members are adhesively attached or integrally formed with the compression cylinders to provide direct restoring force to the compression cylinder during relaxation of the deformed arcuate members.

Figure 5:
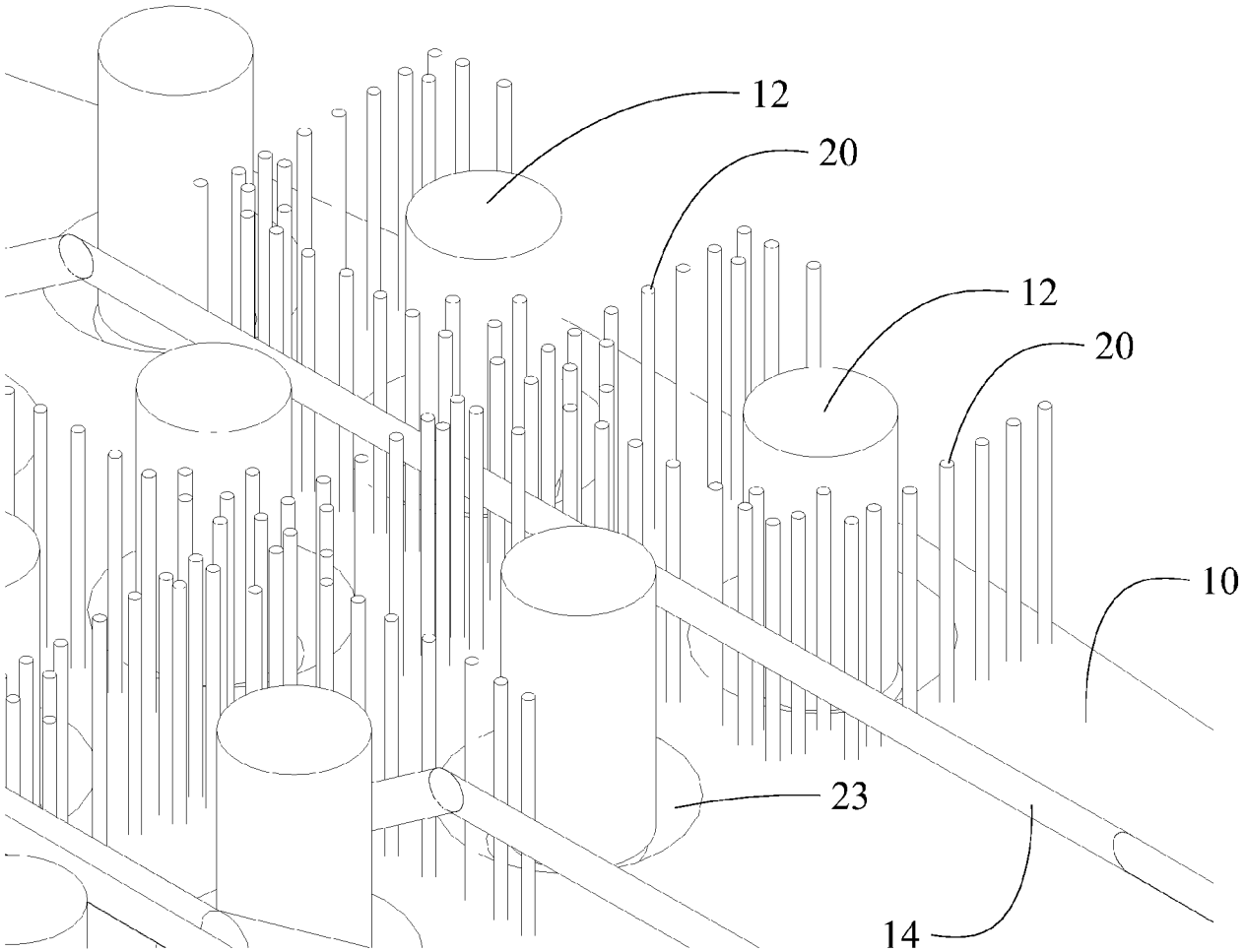
FIG. 5 is a detailed isometric view of an embodiment of the invention including a single compression cylinder and multiple resilient filaments.

FIG. 5 shows an additional embodiment for a supplemental energy absorbing structure. Upstanding resilient filaments 20 are provided between the compression cylinders. During foot strike, deformation of the resilient filaments assists in energy dissipation and upon release relaxation of the deformed filaments provides restoring force against the foot bed as previously described for the arcuate members. While shown in FIG. 5 as present in the toe portion of the shoe, the upstanding filaments may be positioned in the heel portion as shown in FIG. 7C, which will be discussed in greater detail subsequently. In selected embodiments the upstanding filaments are used in combination with the arcuate members and may be used for providing resilient structural separation of the foot bed and sole pad intermediate compression cylinders where arcuate members are not employed. For the embodiment shown in the drawings the upstanding filaments are mounted to or integrally formed with the sole pad. In alternative embodiments the filaments may depend from the foot bed, may alternately extend from the sole pad and depend from the foot bed or constitute an interconnection between the sole pad and foot bed in a skeletal arrangement.

Figure 6:
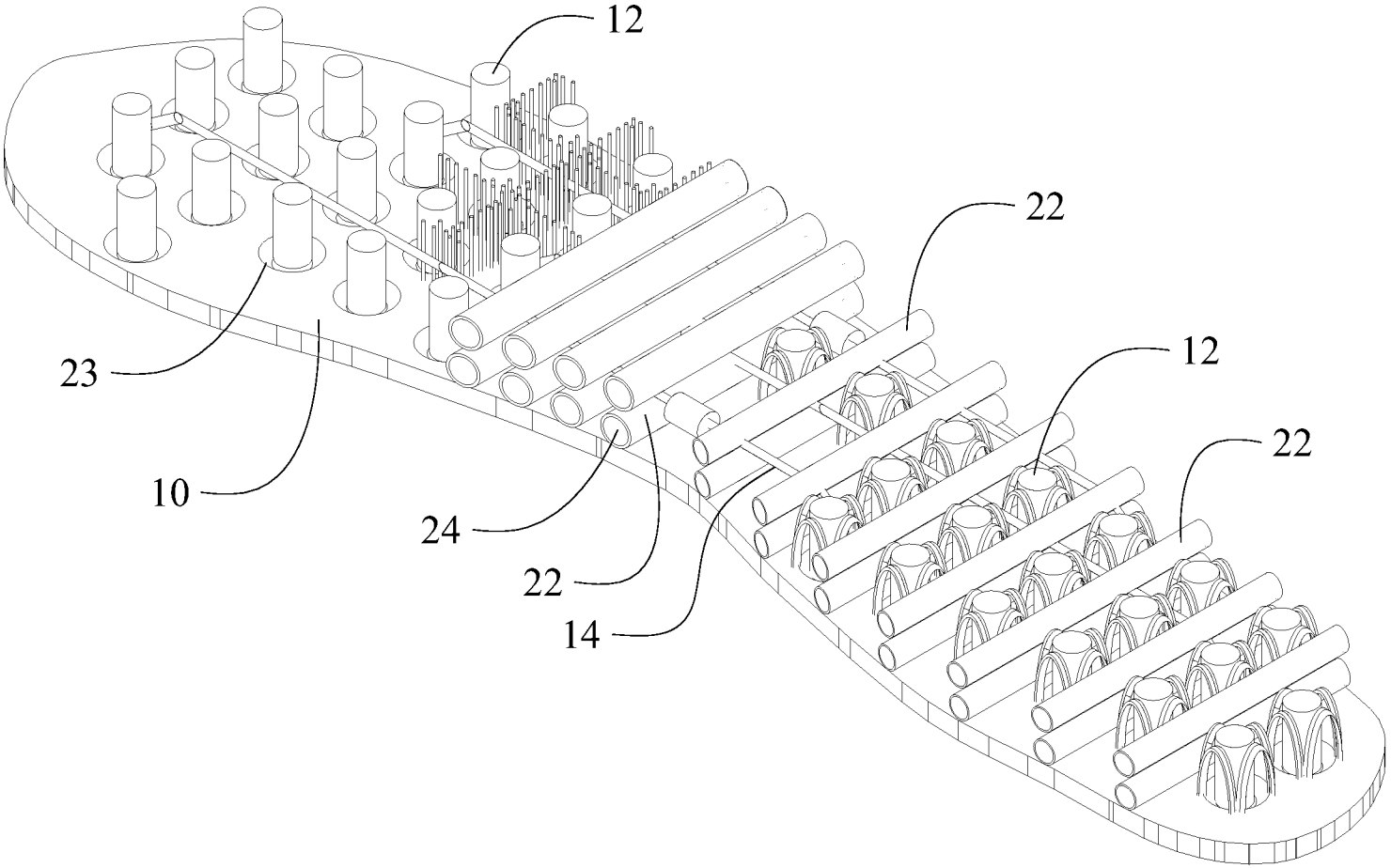
FIG. 6 is an isometric view of an embodiment of the invention incorporating lateral cooling tubes in a first configuration.

Referring to FIG. 6, cooling tubes 22 are mounted at various locations in the shoe transverse to a longitudinal axis of the sole pad. Compression and expansion of the cooling tubes during normal or walking or running action creates airflow through the open channels 24 in the tubes. Heat transfer through the transferred air allows cooling of the foot bed within the shoe for energy dissipation to the environment and continual transfer of energy from the components of the shoe to the environment. As shown in FIGS. 7B and 7D to be described in greater detail subsequently, the overlying foot bed in combination with the sole pad joined by a peripheral wall 26 provides a cavity 28 in which a second working fluid is contained. Presence of the second working fluid in the cavity additionally assists the resilient structural members in providing support. In exemplary embodiments, purified or deionized water is employed as the second working fluid. The working fluid is channeled between the compression cylinders, arcuate or filament resilient members, and the cooling tubes. The working fluid provides additional energy absorbing capability by flowing intermediate the various structural members during relative compression of the cavity between the foot bed and sole pad during normal walking or running motion. Additionally the working fluid, by bathing the compression cylinders, arcuate and filament resilient members and the lower surface of the foot bed, provides a conductive medium for additional heat transfer to the cooling tubes.

Figure 7A:
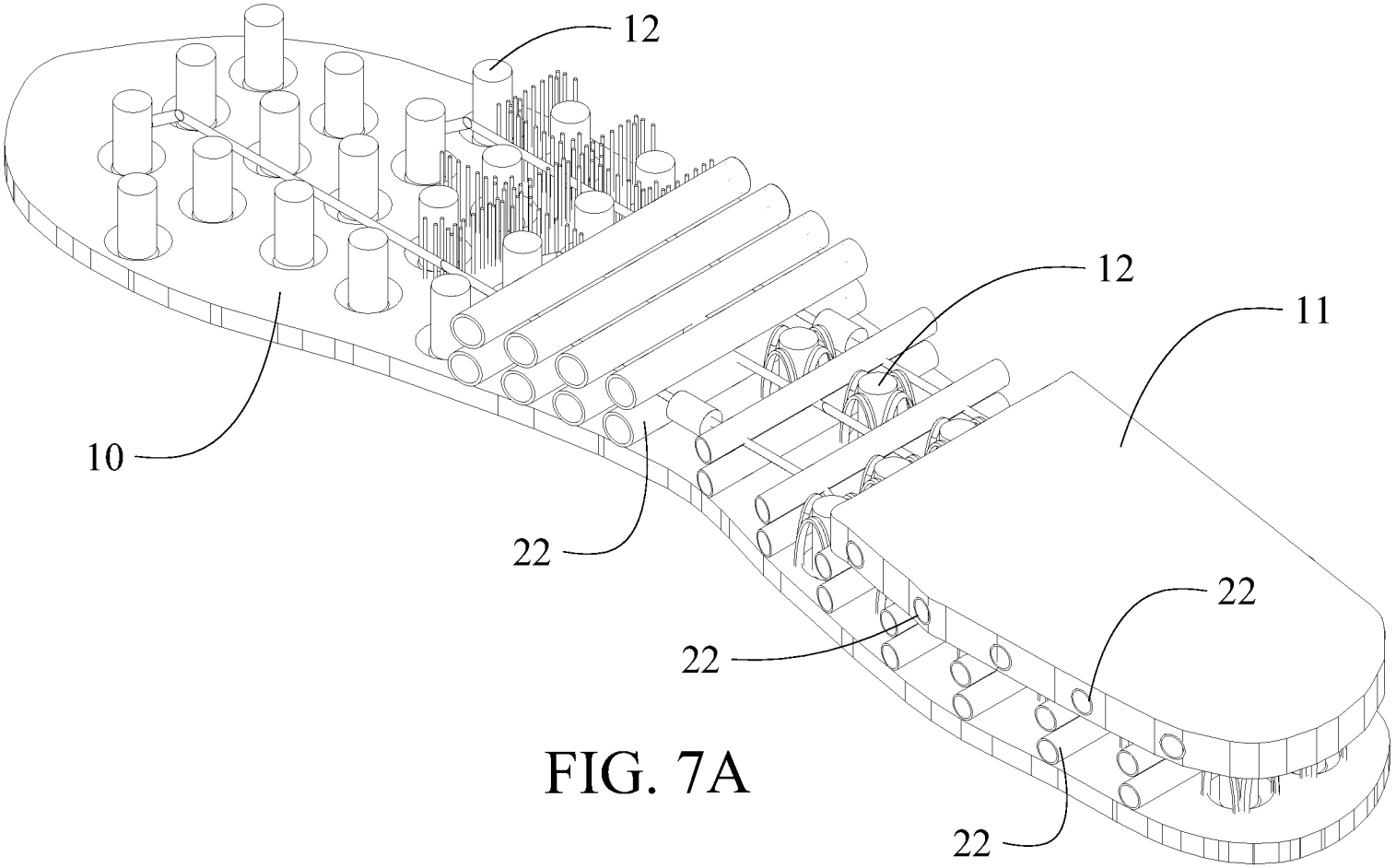
FIG. 7A is an isometric view of the embodiment of FIG. 6 including a heel portion of the foot bed with the remainder of the foot bed deleted for clarity in viewing of elements of the embodiment.
Figure 7B:
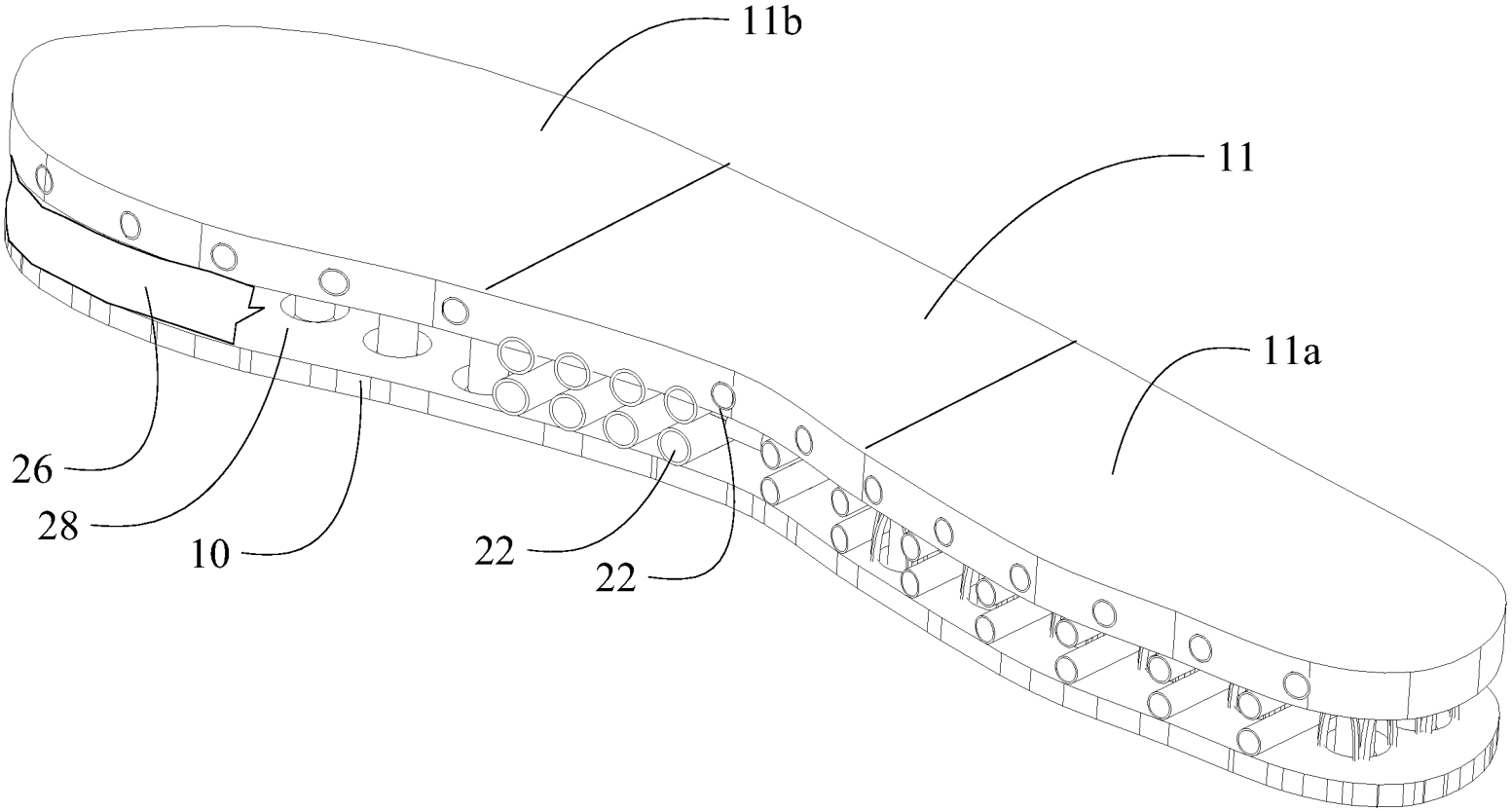
FIG. 7B is an isometric view of the embodiment of FIG. 6 including a the foot bed.
Figure 7C:
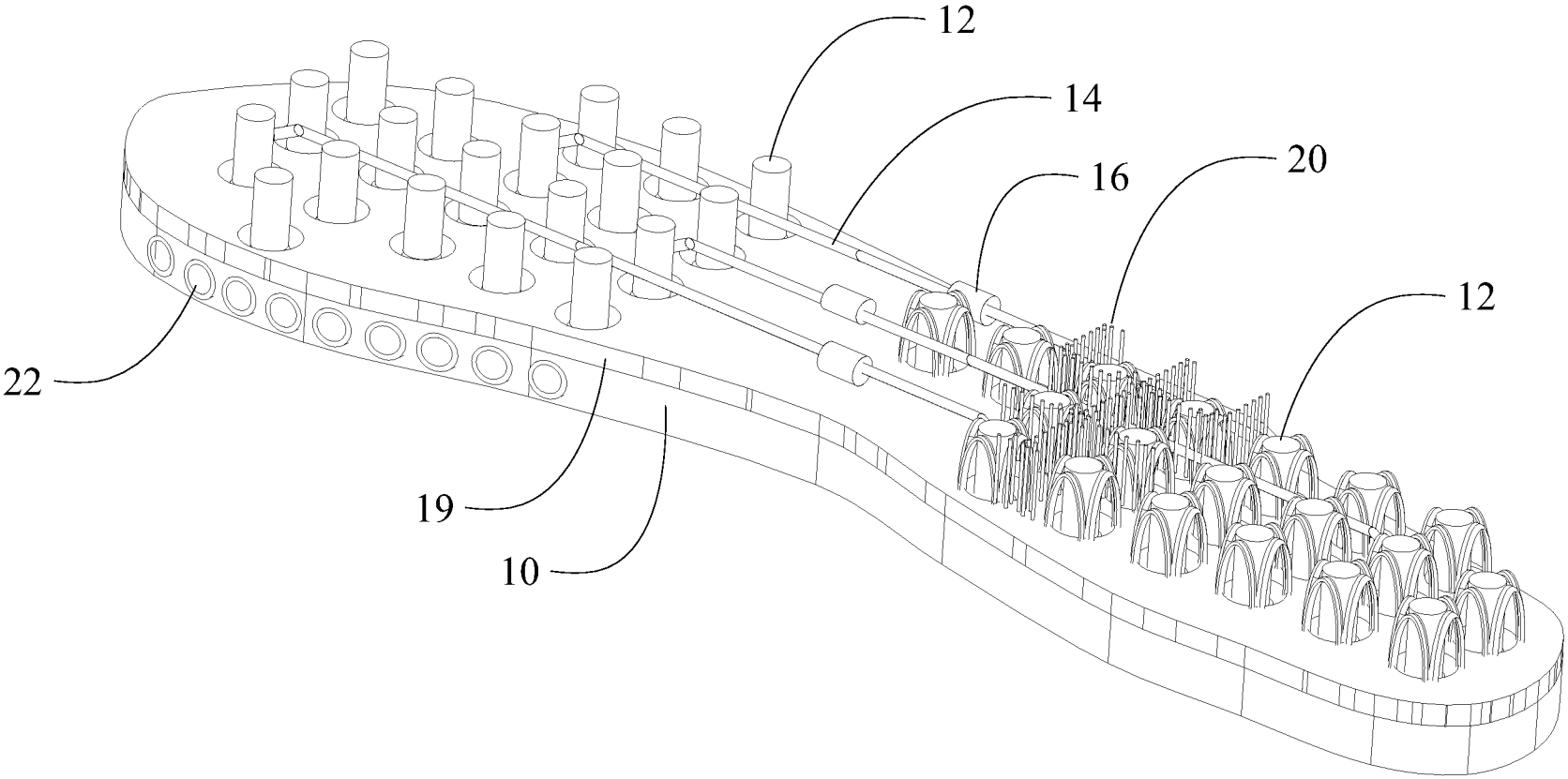
FIG. 7C is an isometric view of a modified embodiment of FIG. 6 with an alternative cooling tube configuration.
Figure 7D:
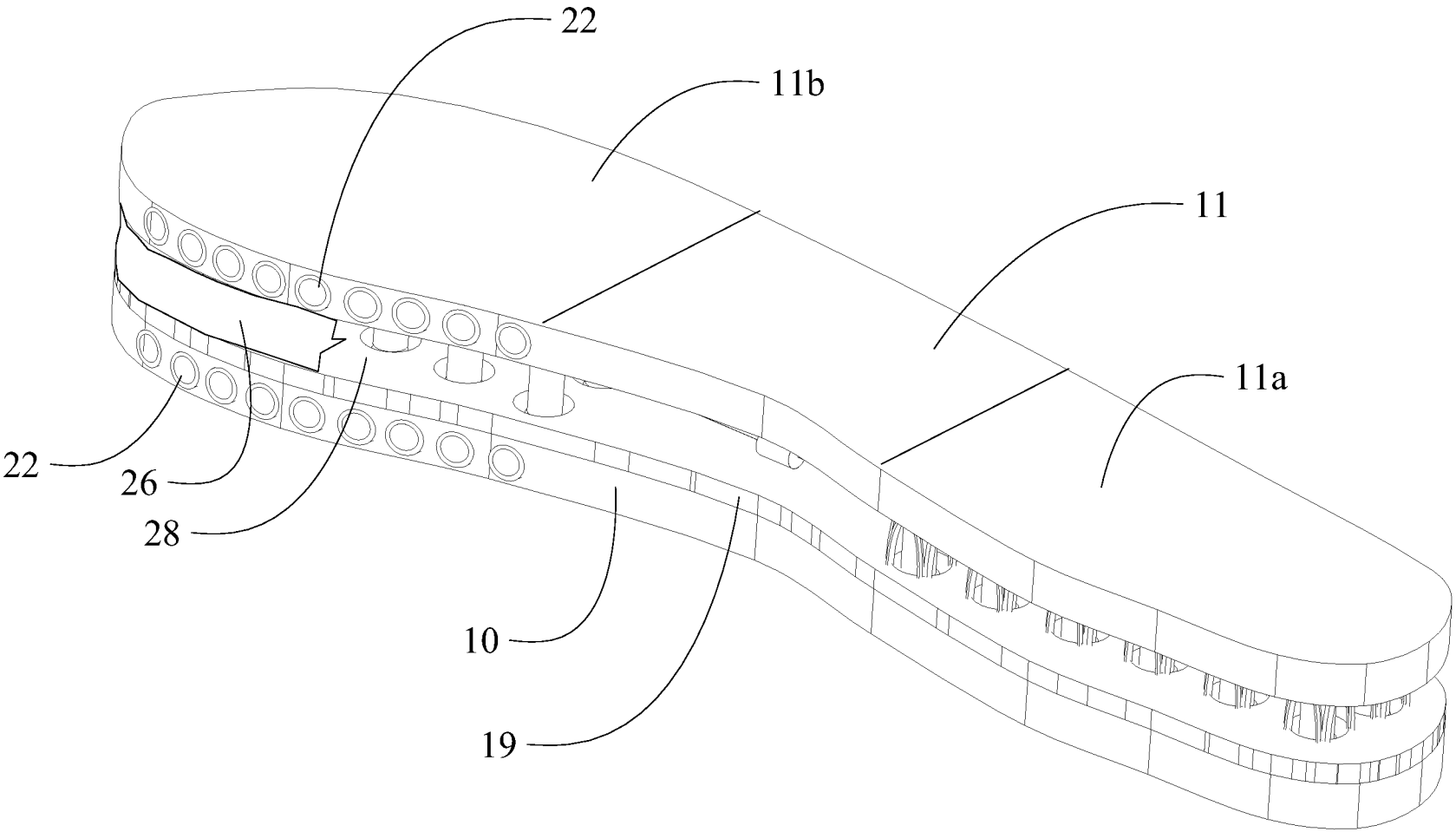
FIG. 7D is an isometric view of the embodiment of FIG. 7C with the foot bed in place.

For the embodiments shown in FIGS. 6, 7A and 7B a portion of the cooling tubes are placed directly adjacent and in thermal contact with conduits 14 for cooling of the first working fluid transferred intermediate the compression cylinders. Additionally, cooling tubes are placed immediately adjacent, laterally or vertically, and in thermal contact with the compression cylinders for direct supplemental cooling. In one exemplary embodiment cooling tubes are integrated in the sole pad or foot bed adjacent connection locations of the compression cylinders. The portion of the foot bed shown in FIG. 7A may be a separable heel plate 11*a* for distribution of the force of a heel strike over the compression cylinders in the heel portion of the shoe. A comparable toe portion of the foot bed may be similarly separated from the foot bed as a whole for a similar effect in the toe portion as designated by element 11*b* in FIG. 7B.

FIGS. 7C and 7D show an alternative configuration of the cooling tubes in the system wherein the foot bed and sole plate in the toe portion of the shoe employ embedded cooling tubes for maximum contact and cooling of the second working fluid. Heel strike results in displacement of the fluid into the toe portion carrying energy from the compressed cylinders, fluid flow conduits and deforming resilient members. Intimate contact by the second working fluid with the top of the sole plate and bottom of the foot bed in the toe region and the placement of the cooling tubes immediately adjacent these surfaces allows maximum heat and thereby energy transfer from the working fluid to the environment by air exchange through the cooling tubes. In an advanced embodiment, a conduction plate 19 is employed in the top surface of the sole plate to enhance the heat transfer from the working fluid. While shown in the drawings only associate with the sole plate alternative embodiments employ a second conduction plate associated with the foot bed for enhanced conduction to cooling tubes in both the sole plate and foot bed.

Figure 8:
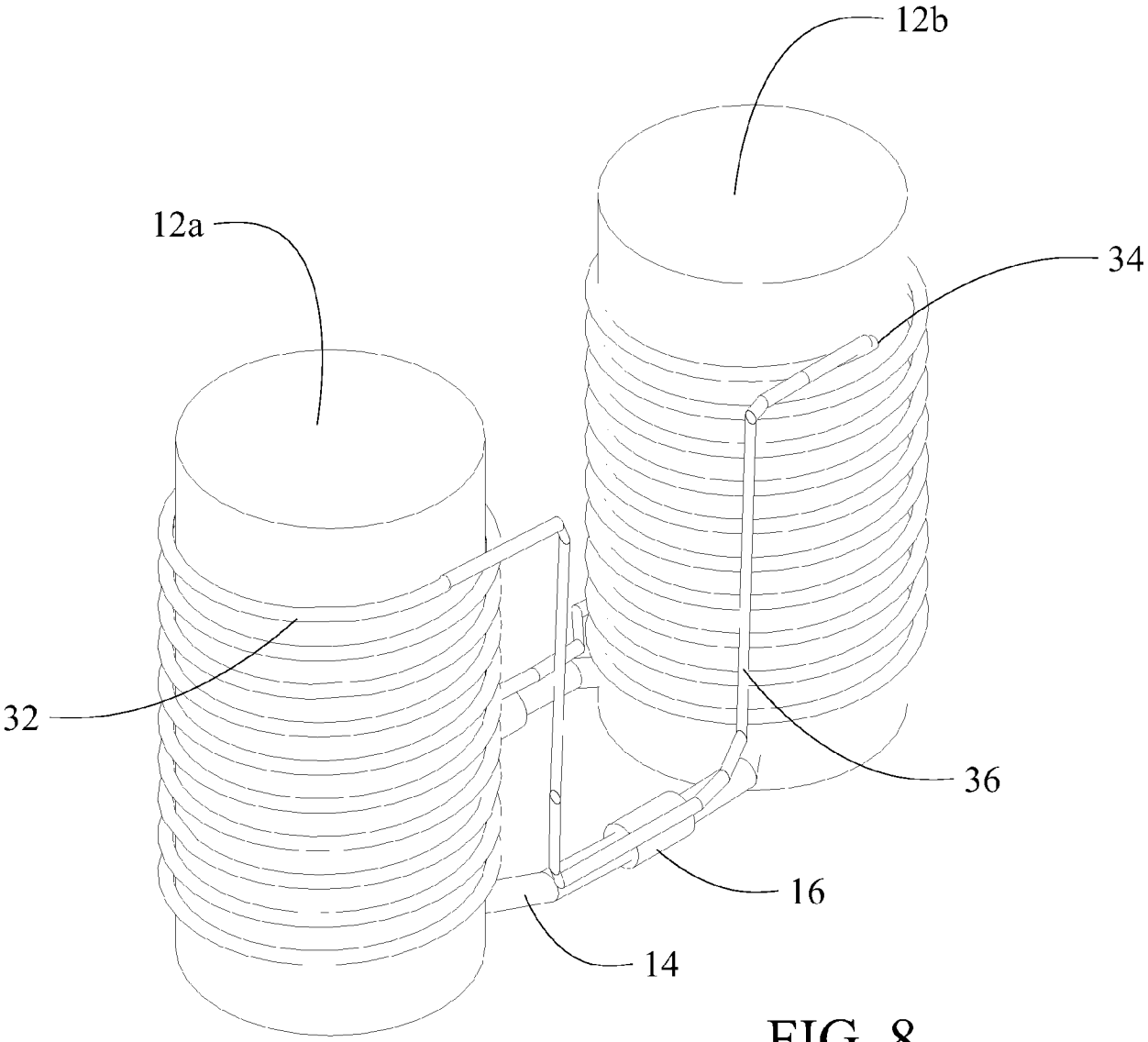
FIG. 8 is an isometric view of the details of an interrelated pair of compression cylinders with magnetic energy dissipation.
Figure 9:
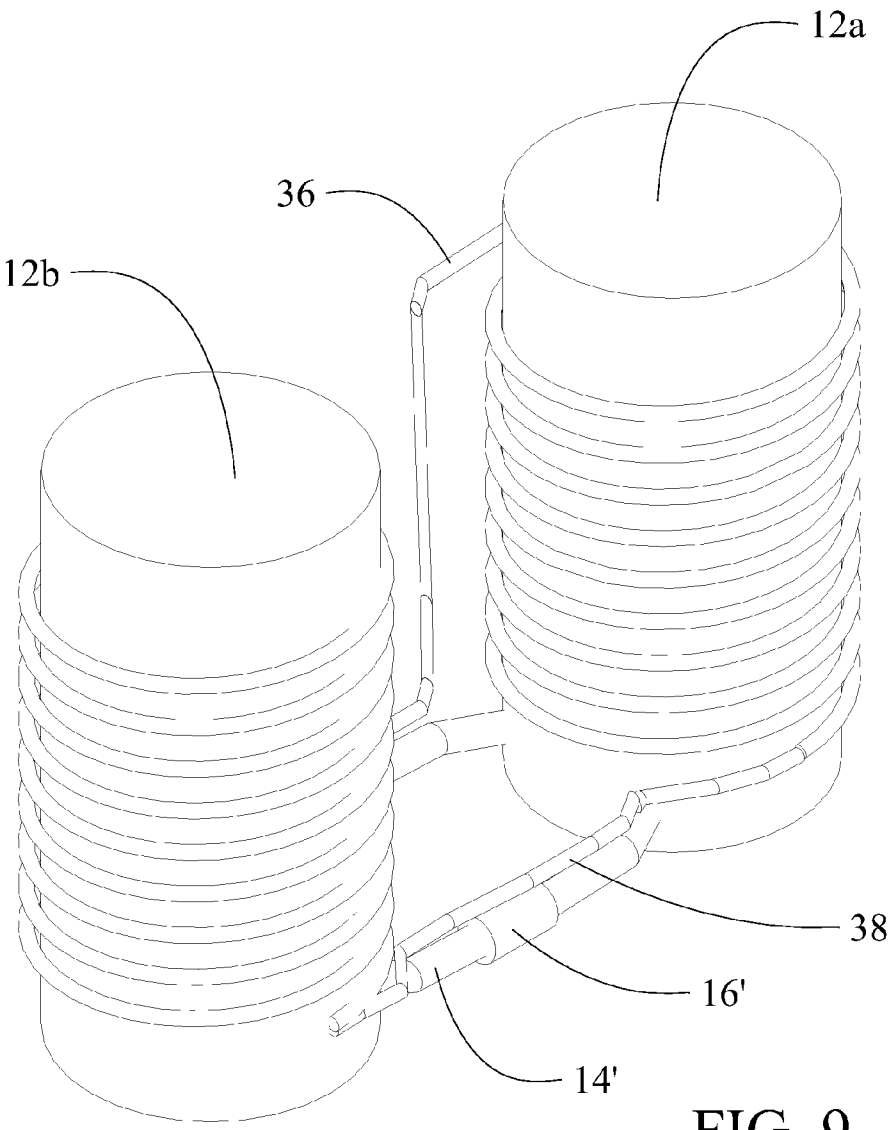
FIG. 9 is a reverse isometric view of the embodiment shown in FIG. 8; and, FIG. 10 is a sectional end in view of the compression cylinder incorporating a buoyant magnet electromagnetic induction coil, impact prevention magnet, and fluid flow ports.
Figure 10:
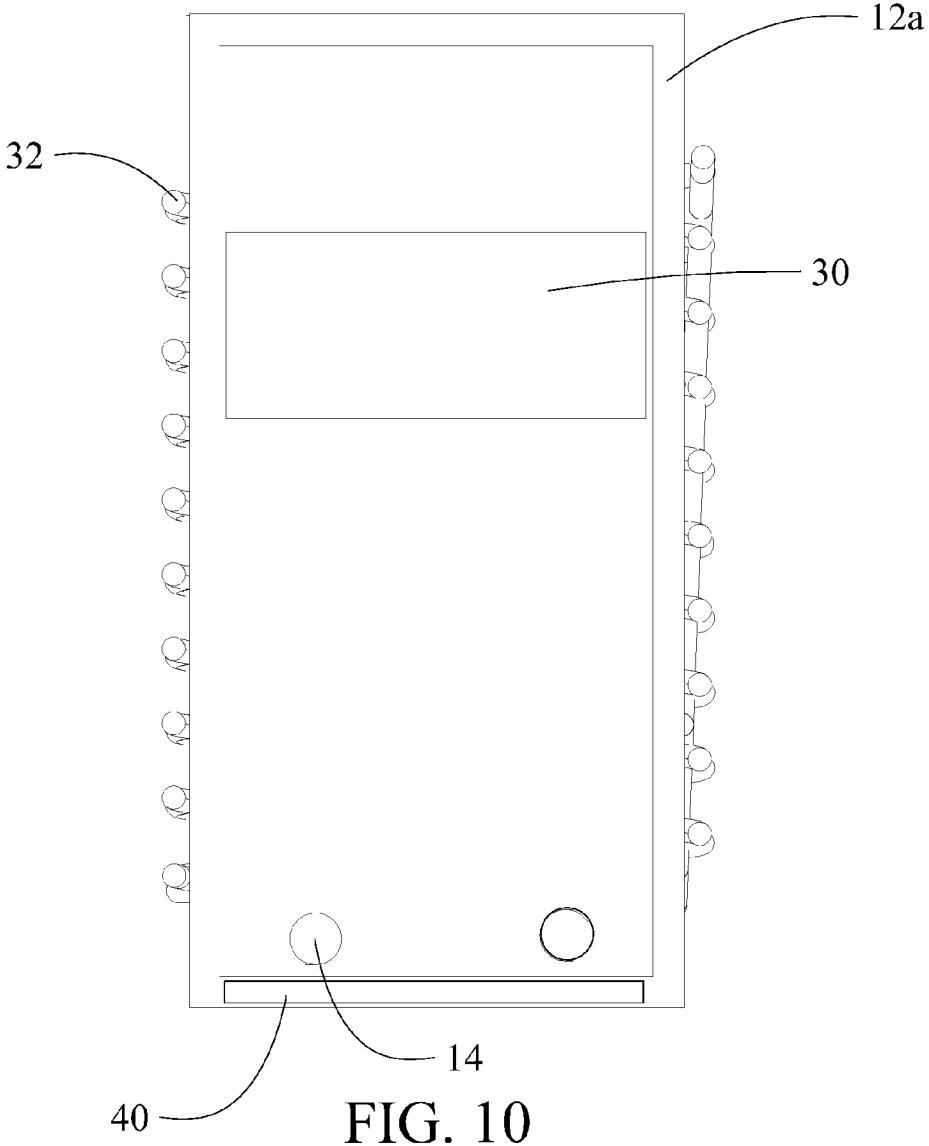

Additional energy dissipation is accomplished through the use of an electromagnetic generation system shown in FIGS. 8, 9 and 10. A buoyant magnet 30 floats in the first working fluid of an exemplary compression cylinder 12*a*. An inductive pickup coil 32 is wrapped around the external surface of the compression cylinder for the embodiment shown. In alternative embodiments, the coil is encased or molded into the cylinder wall. During compression of the cylinder created by foot action as previously described the first working fluid is forced from the cylinder through conduit 14 and the magnet moves axially in the cylinder creating a current in the induction coil. Current generated is resistively dissipated as will be described in greater detail subsequently. For the embodiment shown in the drawings the mating cylinder 12*b* is similarly structured but incorporates an inductive coil 34 with opposite polarity to coil 32. Fluid flowing through conduit 14 and restrictor 16 urges the buoyant magnet in cylinder 12*b* upwardly. Interaction between the buoyant magnet in cylinder 12*b* and inductive coil 34 provides additional energy dissipation through a combination of both electromagnetic driving force from the current created by coil 32 and reversed EMF created by motion of the buoyant magnet. Resistance of the interconnecting wires 36 and 38 between the two inductive coils may be increased by the use of additional resistive elements. While embodiment shown in the drawings employs two coils, use of a single coil on one compression cylinder with a resistive wire loop extending from the coil provides the desired energy dissipation in alternative embodiments.

In addition, the embodiment shown in the drawings provides a parallel fluid conduit 14' with an integral restrictive element 16' for transfer of the working fluid the use of two conduits allows two fluid flow paths which may be associated with interconnecting electrical wires 36 and 38 respectively. Heat generated by the resistive dissipation of the induced current is transferred to the second working fluid. Intimate contact of the wires and any associated resistive elements with the fluid conduits allows enhanced heat conduction from the resistive dissipation of the electromagnetically created current. The wires are shown separate from and mounted to the surface of the conduits in the embodiments of the drawings, however, in alternative embodiments, the wires may be integrally molded into the conduit walls. As described for the embodiments of FIGS. 6 and 7 bathing of the electrical wires and first working fluid conduits in the second working fluid provides dissipation of the heat generated through the cooling tubes.

While the embodiments shown in FIGS. 8, 9 and 10 employ an induction coil integrally mounted to the compression cylinder, alternative embodiments employing a separate coil concentric with the compression cylinder. The coil may take the form of a resilient spring mounted intermediate the foot bed and a sole pad thereby providing additional energy dissipation during relative compression created by foot strike.

As best seen in FIG. 10, a repelling magnet 40 is mounted in the base of compressible cylinder 12*a*. The repelling magnet has an opposite polarity to the buoyant magnet and provides magnetic repulsion to reduce or preclude bottoming of the buoyant magnet in the compressible cylinder during foot strike. The repulsion force between the two magnets provides further energy dissipation for the foot strike compressing cylinder 12*a*.

Having now described the invention in detail as required by the patent statutes, those skilled in the art will recognize modifications and substitutions to the specific embodiments disclosed herein. Such modifications are within the scope and intent of the present invention as defined in the following claims.

What is claimed is:

1. A shoe structure for foot strike energy dissipation comprising:

a first plurality of compressible members each having an internal void containing a first working fluid;

a second plurality, equal in number to said first plurality, of mating compressible members each of said second plurality of mating compressible members individually connected directly to a matched one of the first plurality of compressible members with a fluid conduit, said first working fluid transferred from the matched one compressible member to the mating compressible member responsive to compression of the matched one compressible member induced by foot strike;

a sole pad and a foot bed constraining there between the first plurality of compressible members and the second plurality of mating compressible members; and, a plurality of resilient structural members in between said compressible members, said resilient structural members extending from the sole for contact with the foot bed and resiliently deforming responsive to compression of the foot bed induced by foot strike and upon removal of the compression force relaxation wherein four arcuate members circumscribe each compressible member with each arcuate member substantially perpendicular to adjacent arcuate members.

2. A shoe structure for foot strike energy dissipation comprising:

a first plurality of compressible members each having an internal void containing a first working fluid;

a second plurality, equal in number to said first plurality, of mating compressible members each of said second plurality of mating compressible members individually connected directly to a matched one of the first plurality of compressible members with a fluid conduit, said first working fluid transferred from the matched one compressible member to the mating compressible member responsive to compression of the matched one compressible member induced by foot strike;

a sole pad and a foot bed constraining there between the first plurality of compressible members and the second plurality of mating compressible members;

wherein the sole pad and foot bed are interconnected by a peripheral wall forming a cavity and further comprising a second working fluid contained in said cavity and transmissible intermediate said compressible members responsive to compression of the foot bed responsive to foot strike.

3. The shoe structure as defined in claim 2 further comprising a plurality of cooling tubes transversely extending through the shoe for cooling of said second working fluid.

4. The shoe structure as defined in claim 2 further comprising a flow restriction element associated with each of the fluid conduits connecting said mating compressible members to the corresponding one of the first plurality of compressible members wherein the second working fluid bathes the compressible members, fluid conduits and flow restriction elements for heat transfer.

* * * * *